US007915833B2

(12) United States Patent
Chen et al.

(10) Patent No.: US 7,915,833 B2
(45) Date of Patent: Mar. 29, 2011

(54) SINGLE-ENDED DC TO AC POWER INVERTER

(75) Inventors: Wei Chen, Saratoga, CA (US); Yuancheng Ren, Hangzhou (CN); Junming Zhang, Hangzhou (CN); Lei Du, Hangzhou (CN)

(73) Assignee: Monolithic Power Systems, Inc., San Jose, CA (US)

( * ) Notice: Subject to any disclaimer, the term of this patent is extended or adjusted under 35 U.S.C. 154(b) by 73 days.

(21) Appl. No.: 12/036,778

(22) Filed: Feb. 25, 2008

(65) Prior Publication Data

US 2008/0174251 A1 Jul. 24, 2008

Related U.S. Application Data

(63) Continuation-in-part of application No. 11/419,354, filed on May 19, 2006, now Pat. No. 7,336,038, which is a continuation of application No. 10/850,351, filed on May 19, 2004, now Pat. No. 7,161,305.

(51) Int. Cl.
*H05B 37/02* (2006.01)

(52) U.S. Cl. ..... 315/209 R; 315/219; 315/276; 315/291; 363/282

(58) Field of Classification Search ..... 315/219, 315/209 R, 224–226, 276, 291, 307, 360, 315/361; 363/131, 282, 284
See application file for complete search history.

(56) References Cited

U.S. PATENT DOCUMENTS

| | | | | |
|---|---|---|---|---|
| 6,373,725 | B1 * | 4/2002 | Chang et al. | 363/21.01 |
| 6,693,396 | B1 * | 2/2004 | Hsu | 315/291 |
| 7,064,530 | B2 * | 6/2006 | Vogman | 323/267 |
| 2004/0223351 | A1 * | 11/2004 | Kurokami et al. | 363/65 |

* cited by examiner

*Primary Examiner* — Jacob Y Choi
*Assistant Examiner* — Jimmy T Vu
(74) *Attorney, Agent, or Firm* — Perkins Coie LLP

(57) ABSTRACT

An inverter comprising a low-side switching element in series with a first primary winding; a high-side switching element in series with a second primary winding, where the combination of the low-side switching element and first primary winding is connected in parallel with the combination of the high-side switching element and the second primary winding; and a clamping capacitor having one terminal connected to the first primary winding and having a second terminal connected to the second primary winding. Other embodiments are described and claimed.

18 Claims, 11 Drawing Sheets

SINGLE-ENDED DC TO AC POWER INVERTER

PRIORITY CLAIM

This application is a continuation-in-part of U.S. patent application Ser. No. 11/419,354, filed on 19 May 2006, which is a continuation of U.S. patent application Ser. No. 10/850,351, filed 19 May 2004, issued into U.S. Pat. No. 7,161,305 B2 on 9 Jan. 2007.

FIELD

The present invention relates to power circuits, and more particularly, to inverter circuits for converting DC power to AC power.

BACKGROUND

Power inverter circuits convert DC power to AC power, and find widespread applications in many systems. For example, power inverters are often used to drive cold cathode fluorescent lamps in liquid crystal display monitors.

Two prior art power inverter circuits are illustrated in FIGS. 11 and 12, and their operations are well known in the art of power inverter circuits. Such circuits may experience voltage spike problems. For example, the push-pull inverter circuit of FIG. 12 may experience voltage ringing of three to four times the input source voltage $V_{IN}$. As a result, snubbers are often used to suppress ringing. But typically, such snubbers dissipate power.

DESCRIPTION OF EMBODIMENTS

In the description that follows, the scope of the term "some embodiments" is not to be so limited as to mean more than one embodiment, but rather, the scope may include one embodiment, more than one embodiment, or perhaps all embodiments.

Figure 1:
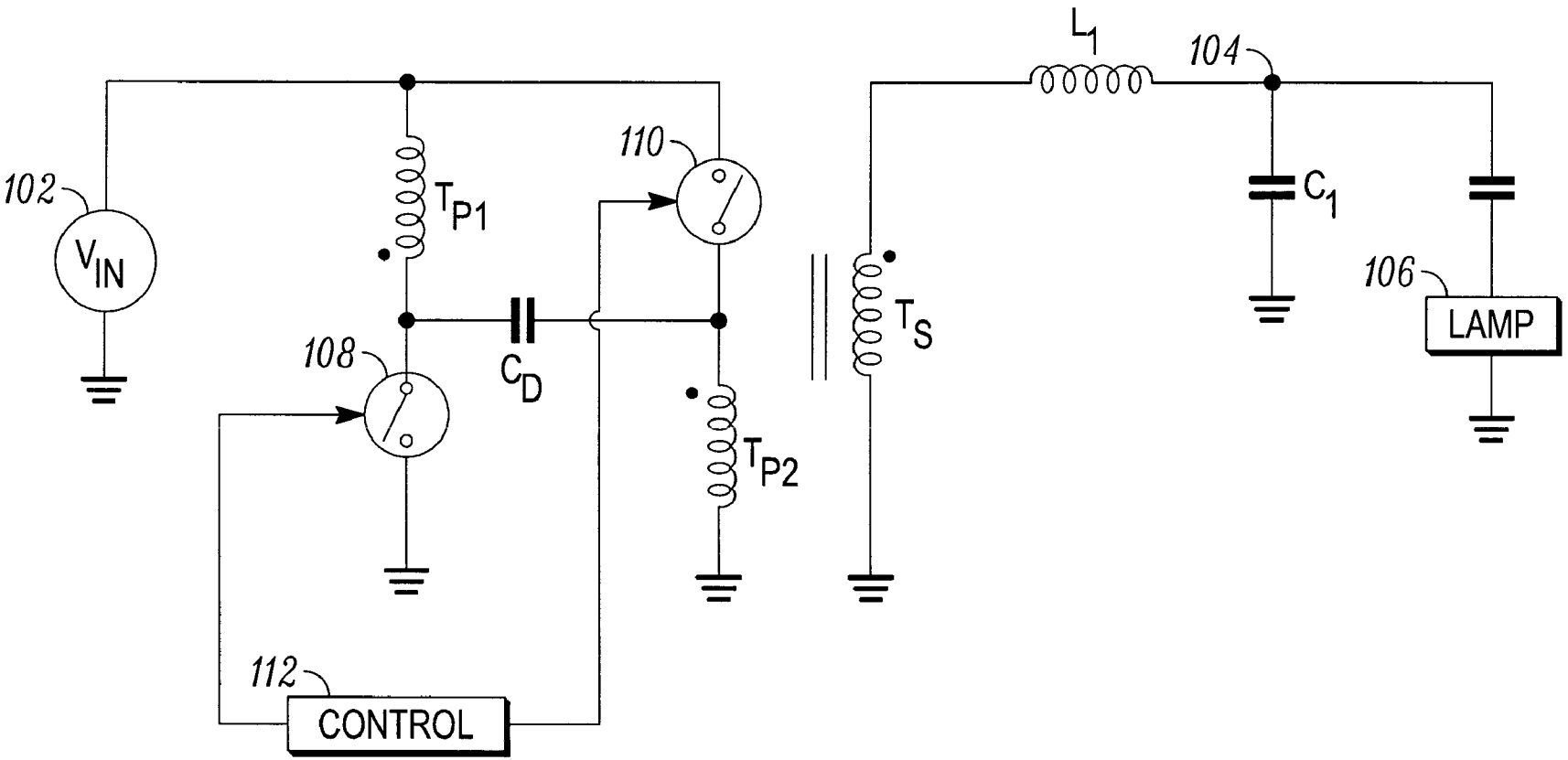
FIG. 1 illustrates an inverter according to an embodiment.

FIG. 1 illustrates a power inverter circuit according to an embodiment. Voltage source 102 is a DC (Direct Current) voltage source. The output at node (port) 104 provides an AC (Alternating Current) voltage to discharge lamp 106. Discharge lamp 106 may be a cold cathode fluorescent light (CCFL), for example. Embodiments are not necessarily limited to driving lamps, so that other types of loads may be driven. Furthermore, more than one load may be driven for some embodiments.

Windings $T_{P1}$, $T_{P2}$, and $T_S$ are windings in a transformer. Windings $T_{P1}$ and $T_{P2}$ form a first primary winding and a second primary winding of the transformer, and winding $T_S$ forms a secondary winding of the transformer. As is conventionally done in transformer symbols, the relative placement of the terminal dots as shown in FIG. 1 indicate the relative algebraic signs of various voltage drops across the windings due to the mutual magnetic coupling among windings $T_{P1}$, $T_{P2}$, and $T_S$. That is, let a first voltage difference be the voltage difference between the (dotted) terminal of $T_{P1}$ directly connected to capacitor $C_D$ and the terminal of $T_{P1}$ directly connected to voltage source 102, a second voltage difference be the voltage difference between the (dotted) terminal of $T_{P2}$ directly connected to capacitor $C_D$ and the terminal of $T_{P2}$ directly connected to ground, and a third voltage be the voltage difference between the (dotted) terminal of $T_S$ directly connected to inductor $L_1$ and the terminal of $T_S$ directly connected to ground. Then, for the relative positions of the terminal dots as indicated in FIG. 1, these three voltage differences all have the same algebraic sign.

It should be appreciated that the placement of the terminal dots are relative to each other, so that all dots of the first and second primary windings as shown in FIG. 1 may be moved to the other winding terminals simultaneously. Furthermore, it should be appreciated that the placement of the dot for secondary winding $T_S$ may be on its other terminal. Stated more generally, the first and second voltage differences as defined in the previous paragraph have the same algebraic sign, but not necessarily the same algebraic sign as the third voltage difference.

For some embodiments, windings $T_{P1}$ and $T_{P2}$ are such that the first and second voltage differences as defined above are substantially equal to each other. For some embodiments, as discussed below with respect to FIG. 2, capacitor $C_D$ and windings $T_{P1}$ and $T_{P2}$ may be designed so that the average voltage difference across capacitor $C_D$ is substantially equal to the input source voltage $V_{IN}$ (the voltage of voltage source 102) and the voltage drops across windings $T_{P1}$ and $T_{P2}$ are substantially equal to each other. For such embodiments, it is expected that the voltage drop across switches 108 and 110 do not exceed $2V_{IN}$.

By switching elements 108 and 1100N and OFF at a frequency resonant with the frequency of the tank circuit formed by inductor $L_1$ and capacitor $C_1$, DC power is provided by voltage source 102 and AC power is delivered to lamp 106.

Figure 2:
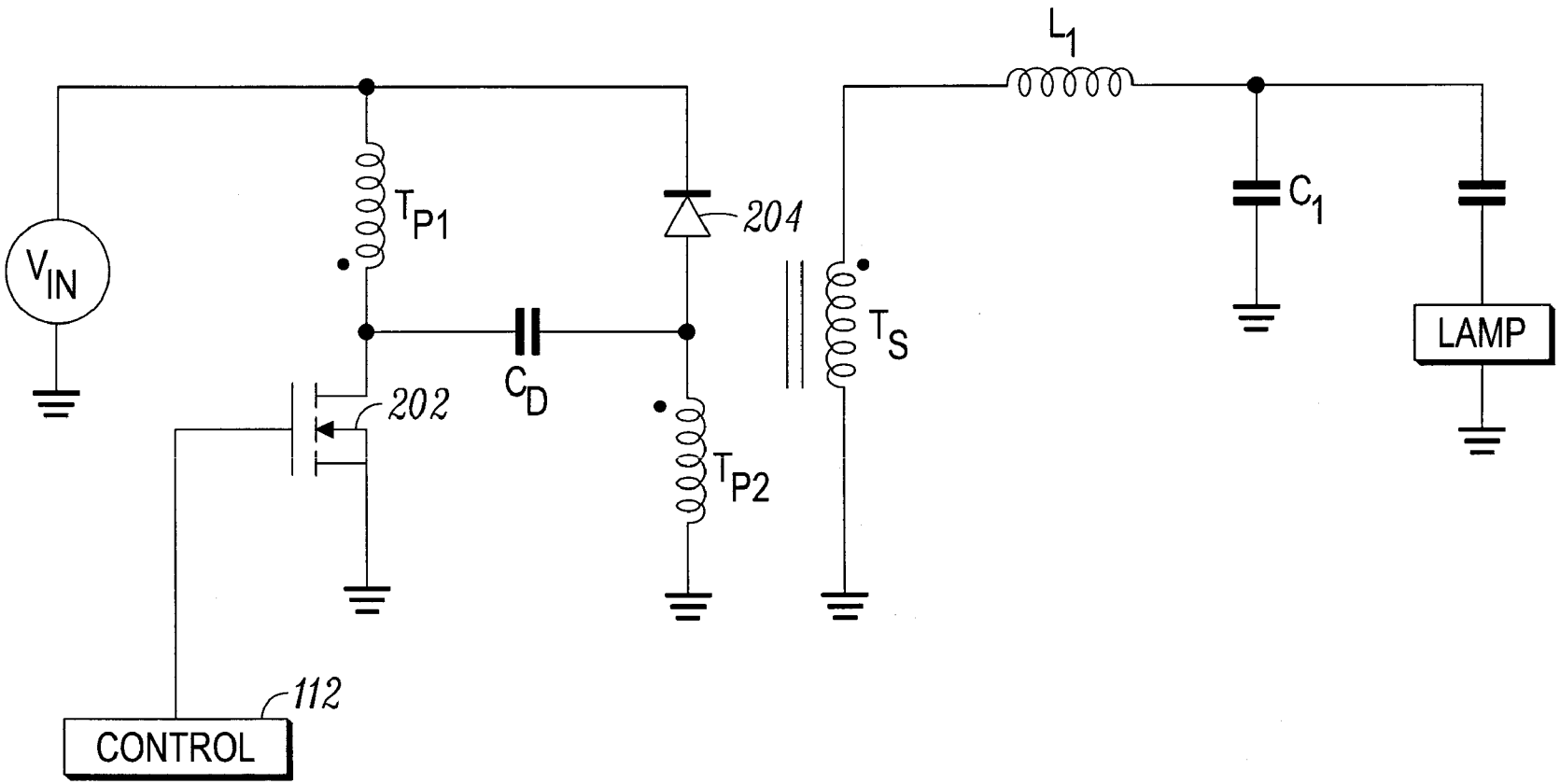
FIG. 2 illustrates an inverter according to an embodiment.

FIG. 2 illustrates an embodiment, where power nMOSFET 202 (n-Metal-Oxide-Semiconductor Field Effect Transistor) serves as switching element 108, and diode 204 serves as switching element 110. In FIG. 2, control circuit 112 does not directly control the action of diode 204. Accordingly, the connections between control circuit 112 and switching elements 108 and 110 in FIG. 1 do not necessarily imply that there are direct connections.

When nMOSFET 202 turns ON, secondary winding $T_S$ receives energy from the input source and from the energy stored in capacitor $C_D$. The drain-source current through nMOSFET 202 is the sum of the magnetizing inductance current of the transformer and the reflected resonant inductor current due to $L_1$. In this situation diode 204 is OFF.

When nMOSFET 202 turns OFF, the reflected resonant inductor current due to inductor $L_1$ flows through diode 204 to continue its resonance. The drain voltage of nMOSFET 202 is then brought up to $V_{IN}+V_C$, where $V_C$ is the voltage across capacitor $C_D$. Capacitor $C_D$ may be designed to be large enough so that $V_C$ is substantially constant and substantially equal to $V_{IN}$. Therefore, the maximum voltage stress on nMOSFET 202 is expected to be about $2V_{IN}$.

The current through diode 204 is the sum of the magnetizing current and the reflected resonant inductor current due to $L_1$. Because the reflected resonant inductor current changes polarity, at times the net current through diode 204 will decrease to zero. The drain voltage of nMOSFET 202 may also decrease to $V_{IN}$ and oscillate around this level. This oscillation may be caused by the leakage inductance between primary windings $T_{P1}$ and $T_{P2}$ and the parasitic capacitance of these primary windings, and nMOSFET 202.

Figure 3:
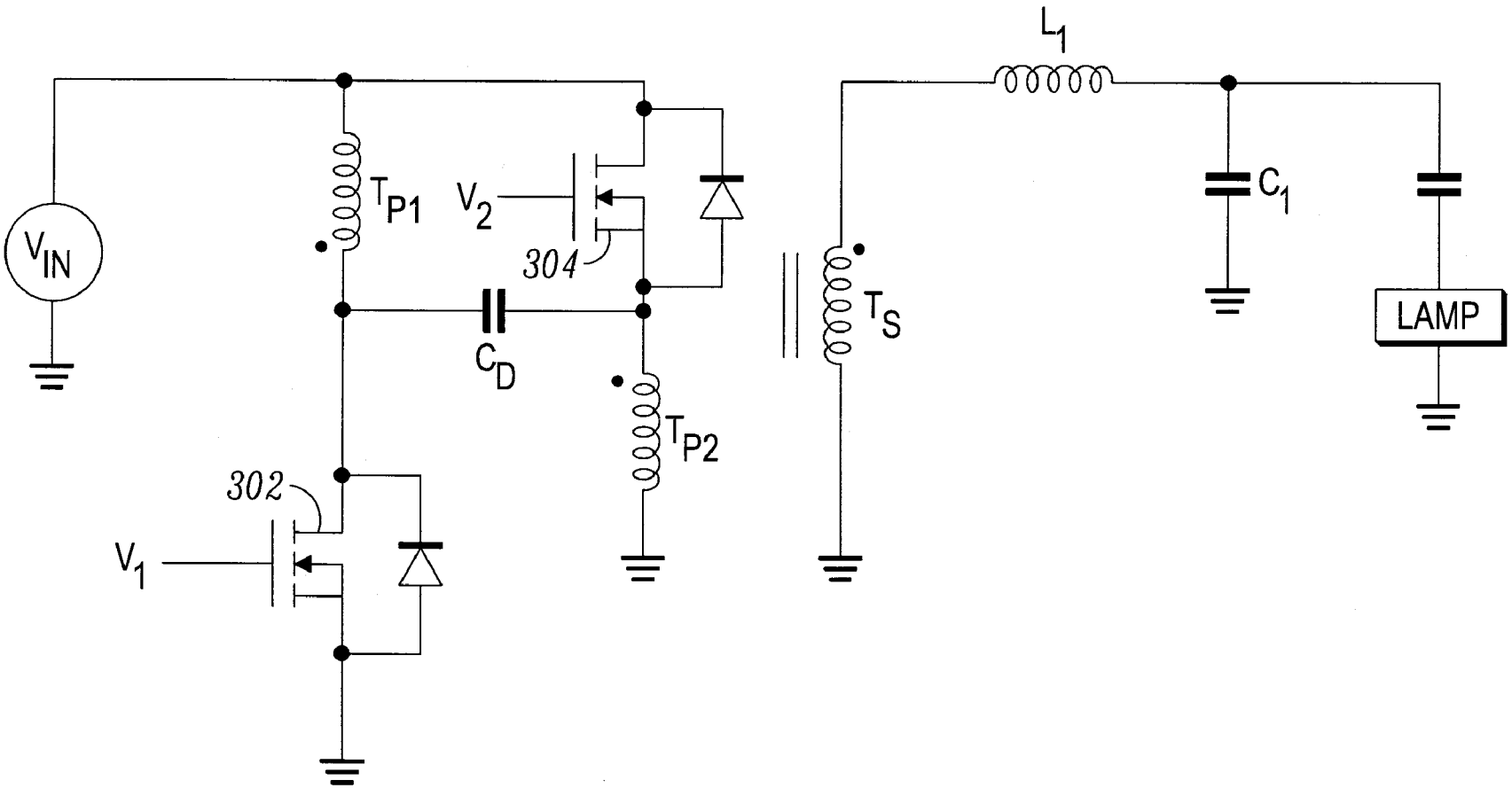
FIG. 3 illustrates an inverter according to an embodiment.

For high-power applications, the current through diode 204 may be large enough to overheat diode 204 due to its power loss. In this case, some embodiments may replace diode 204 with a low drain-to-source ON resistance ($R_{DS}$(ON)) MOSFET. FIG. 3 illustrates an embodiment in which switching element 108 comprises power nMOSFET 302, and switching element 110 comprises power nMOSFET 304. Their respective body diodes are shown in FIG. 3. For ease of illustration, instead of explicitly showing a control circuit connected to the gates of power nMOSFETs 302 and 304, their gate voltages are indicated as $V_1$ and $V_2$, respectively, which are provided by control circuit 112.

For some embodiments, the ON time of power nMOSFET 304 (time for which power nMOSFET 304 is turned ON) is the same as that of power nMOSFET 302, where the pulses driving the gates of power nMOSFETs 302 and 304 are time interleaved. Such an embodiment is expected to achieve essentially a symmetrical voltage and current drive for a resonant tank, similar to the symmetrical voltage and current drive provided by the prior art push-pull inverter of FIG. 12. However, it is expected that the voltage stress of power nMOSFETs 302 and 304 do not exceed $2V_{IN}$, so that a snubber is not required.

Figure 4:
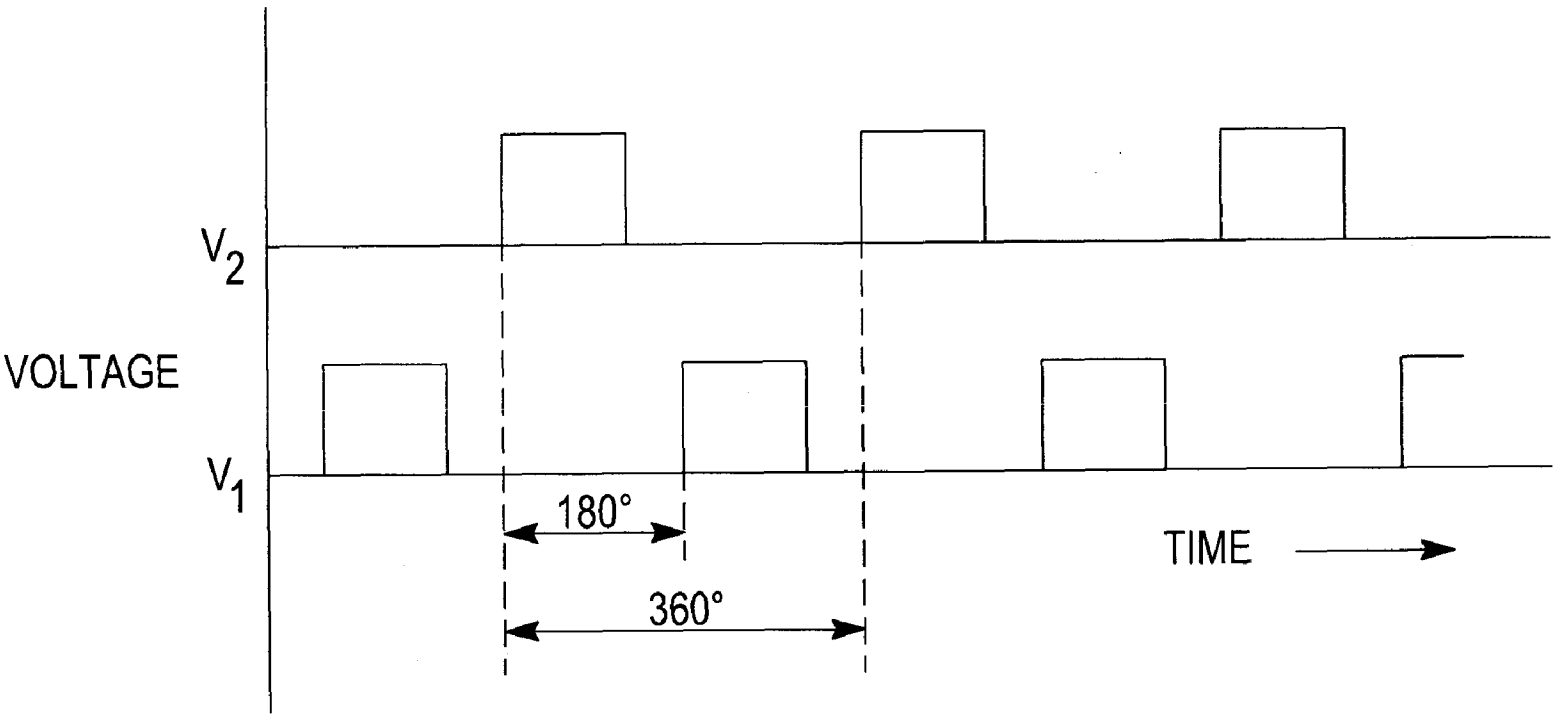
FIG. 4 illustrates gate voltage waveforms for the embodiment of FIG. 3.

The gate voltage waveforms for power nMOSFETs 302 and 304 are illustrated in FIG. 4 for some embodiments. From FIG. 4, it is seen that the period for waveform voltage $V_1$, the gate voltage on power nMOSFET 302, is shifted by 180° (π radians) relative to the waveform for voltage $V_2$, the gate voltage on power nMOSFET 304. Both waveforms have the same ON time.

Figure 5:
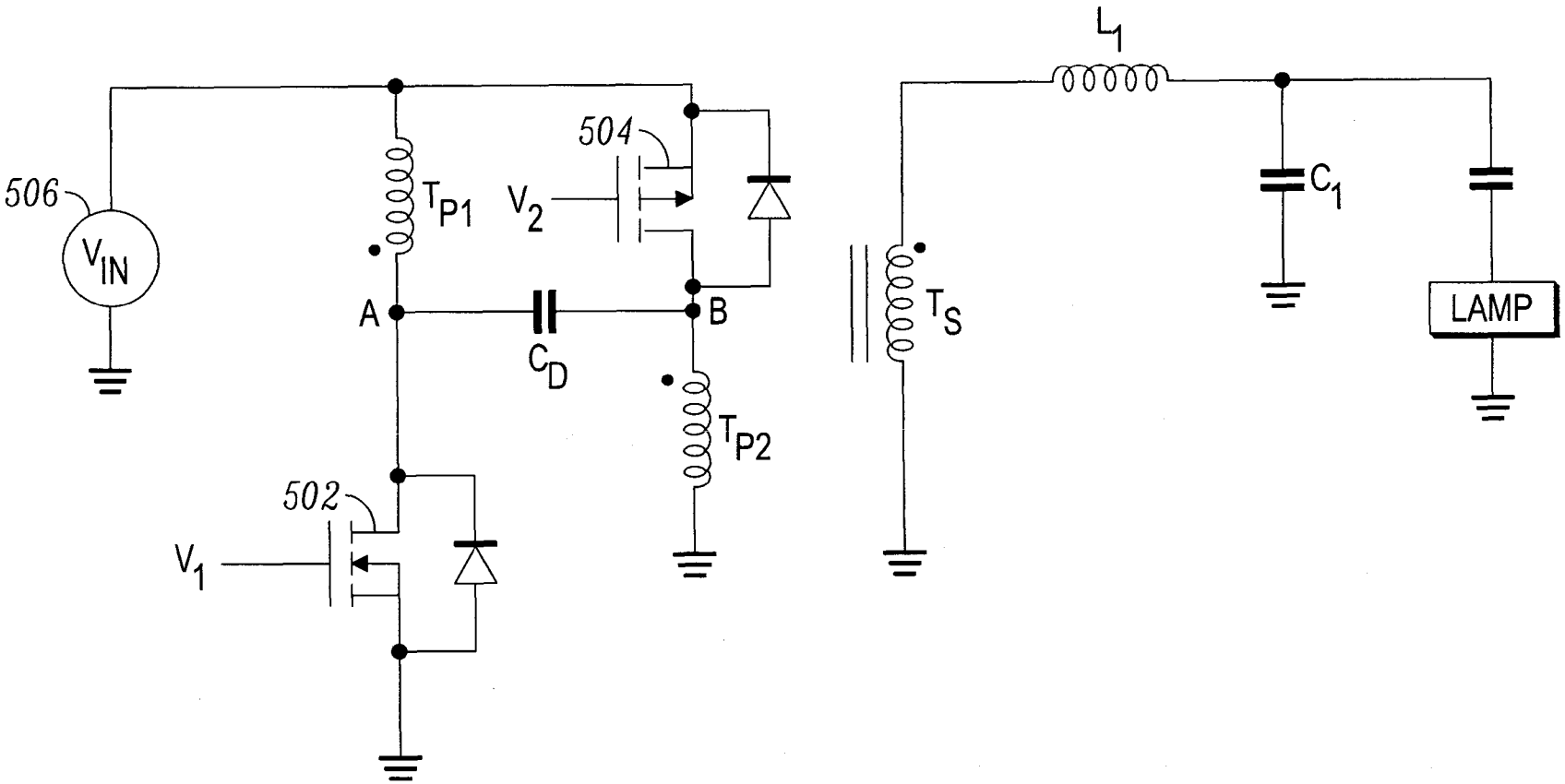
FIG. 5 illustrates an inverter according to an embodiment.
Figure 6:
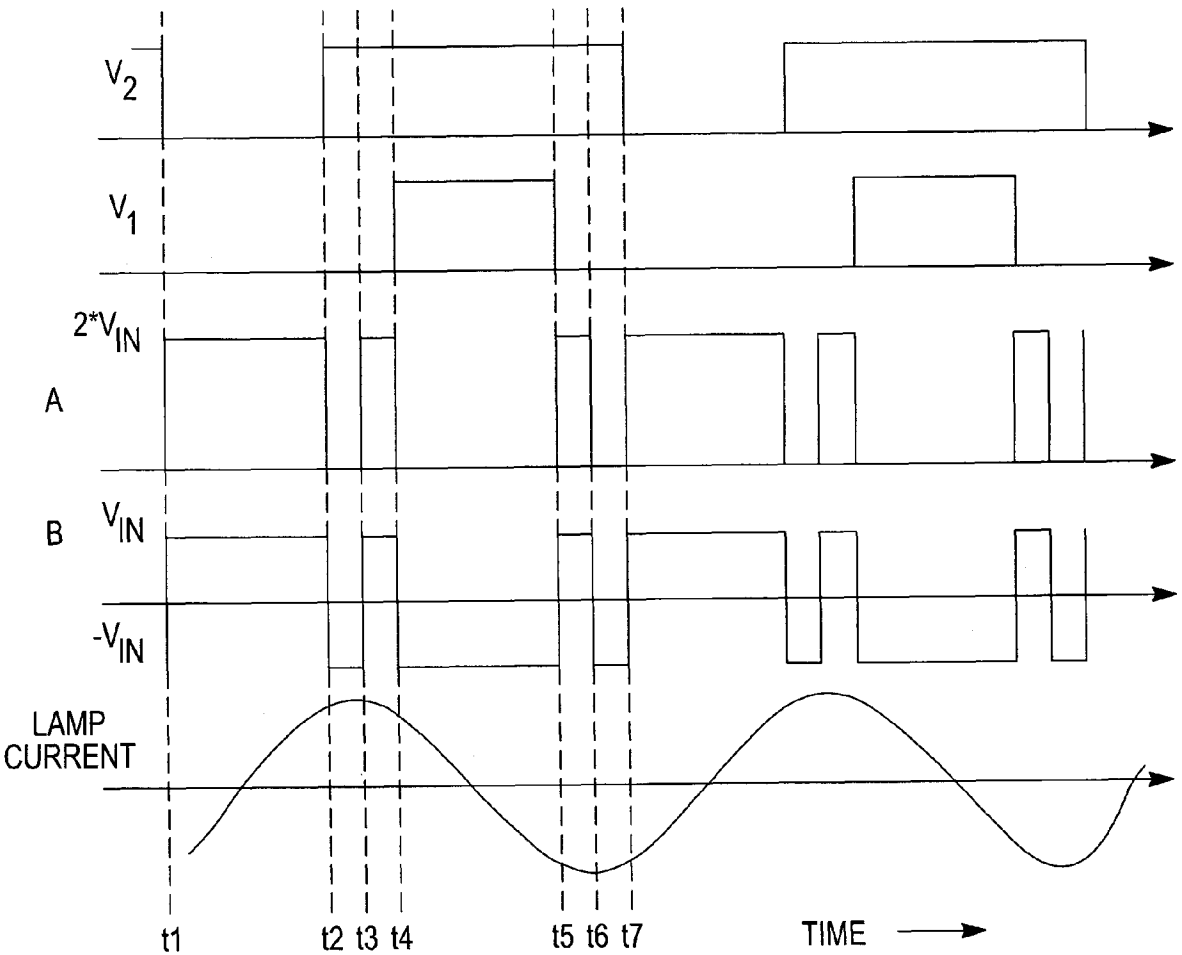
FIG. 6 illustrates gate voltages, nodal voltages, and lamp current for the embodiment of FIG. 5.

FIG. 5 illustrates another embodiment, where as in the embodiment of FIG. 3 switching element 108 comprises a power nMOSFET, labeled 502 in FIG. 5, but where switching element 110 comprises power pMOSFET 504. The gate voltage waveforms V1 and $V_2$ for the embodiment of FIG. 5 are illustrated in FIG. 6. Note that the ON time for the gate voltage of pMOSFET 504, voltage $V_2$, is larger than the ON time for the gate voltage of nMOSFET 502, voltage $V_1$. Because the source node of pMOSFET 504 is tied to the voltage $V_{IN}$ (of voltage source 506), the integration of a gate driver circuit into a controller (e.g., control circuit 112) is expected to be feasible for some embodiments. The embodiment illustrated in FIG. 5 may be of interest for low to medium power applications. Capacitor $C_D$ is sometimes referred to as a clamping capacitor.

Assuming that the voltage on $C_D$ is equal to $V_{IN}$, FIG. 6 illustrates the steady state operation waveforms for an embodiment according to FIG. 5. In FIG. 6, "A" and "B" refer to the node voltages at nodes A and B in FIG. 5. Four operation stages are illustrated in one switching cycle.

During a first stage between times $t_1$ and $t_2$, power pMOSFET 504 turns ON while power nMOSFET 502 turns OFF, so that the voltage at node B is equal to $V_{IN}$. The voltage at node A is clamped roughly to $2V_{IN}$. Both primary windings $T_{P1}$ and $T_{P2}$ receive the positive driving voltage, $V_{IN}$. Consequently, the lamp (load) current increases in the positive direction.

During a second stage between the times $t_2$ and $t_4$, both power pMOSFET 504 and power nMOSFET 502 are OFF. Their body diodes conduct the leakage inductor currents. The voltage at node A is clamped to ground or $2V_{IN}$, and the voltage at node B is clamped to $V_{IN}$ or $-V_{IN}$.

During a third stage between the times $t_4$ and $t_5$, power nMOSFET 502 turns ON and power pMOSFET 504 turns OFF. The voltage at node A is at ground potential and the voltage at node B is equal to $-V_{IN}$. Both primary windings $T_{P1}$ and $T_{P2}$ receive the negative driving voltage, $-V_{IN}$. The lamp current will increase in the negative direction.

During a fourth stage between times $t_5$ and $t_7$, both power nMOSFET 502 and power nMOSFET 504 are OFF. The operation of this stage is the similar to that discussed above with respect to the second stage.

Figure 7:
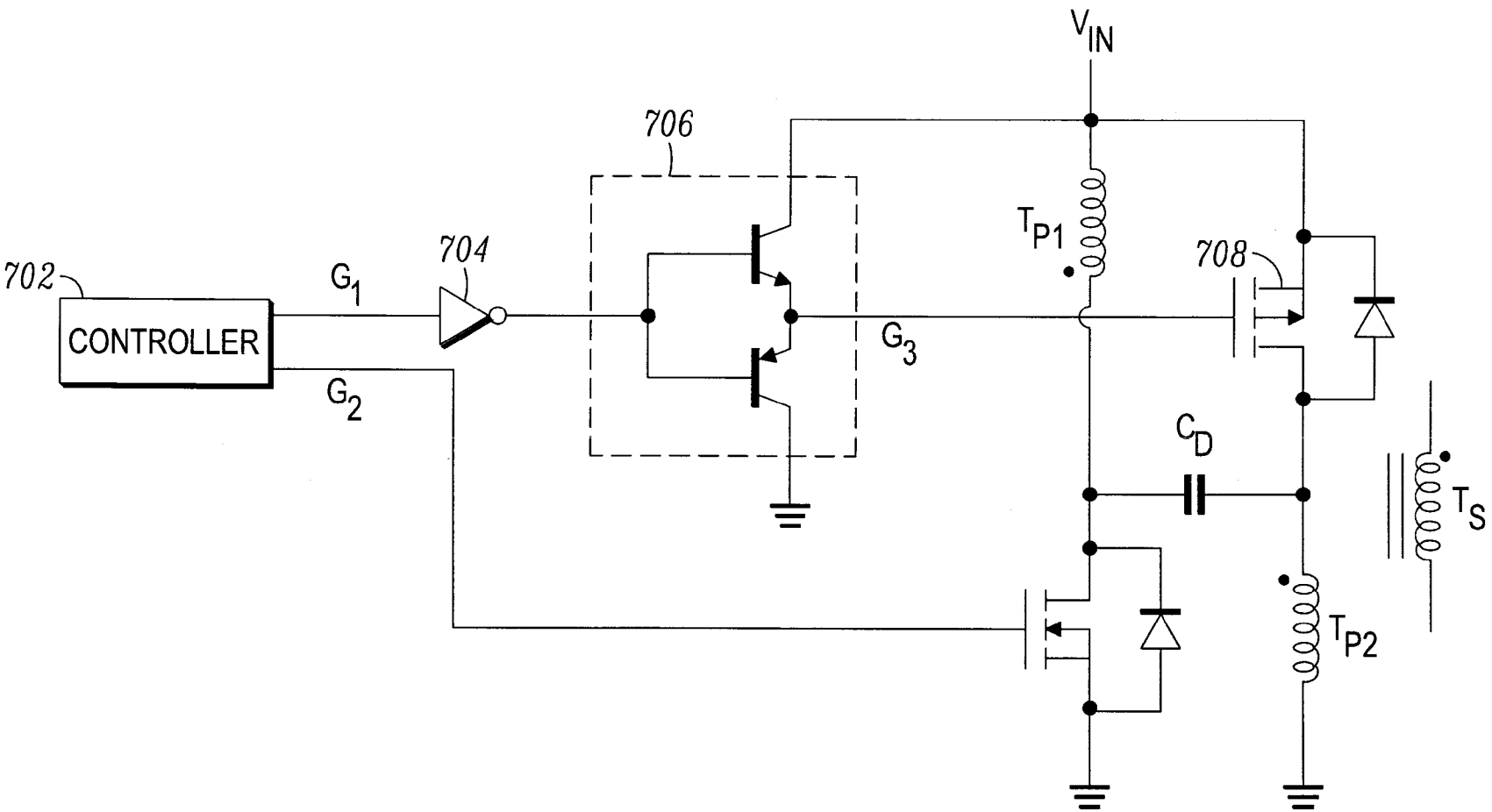
FIG. 7 illustrates an inverter according to an embodiment.
Figure 8:
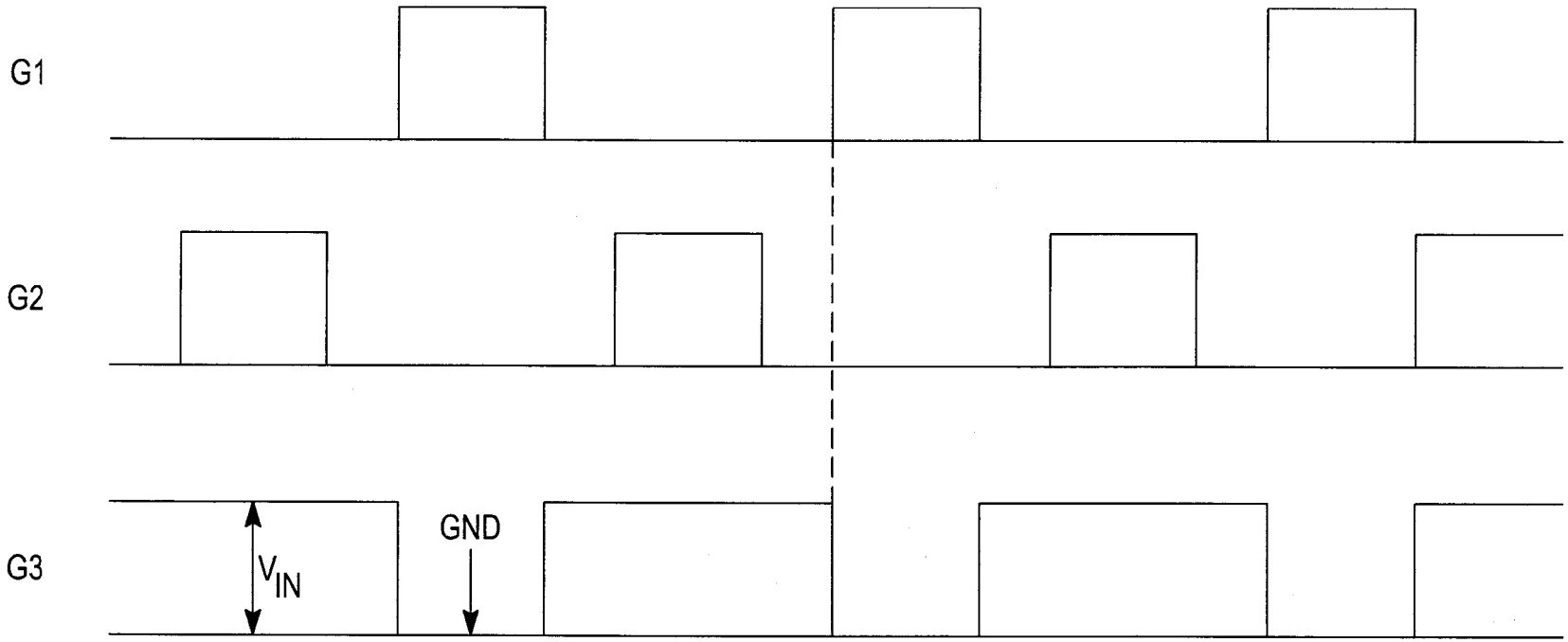
FIG. 8 illustrates nodal and gate voltages for the embodiment of FIG. 7.

If $V_{IN}$ is less than the maximum gate-to-source voltage allowed for power pMOSFET 504, then a relatively simple circuit may be used to provide the gate voltages, as illustrated in the embodiment of FIG. 7 where controller 702 is a conventional push-pull controller well known in the art of power inverter circuits. In FIG. 7, inverter circuit 704 and buffer stage 706 are used to provide the gate voltage of pMOSFET 708. For simplicity of illustration, the circuit related to the load (e.g., discharge lamp 106 and tank circuit $L_1$ and $C_1$) is not shown. The waveform voltages associated with the voltages G1, G2, and G3 indicated in FIG. 7 are illustrated in FIG. 8.

Figure 9:
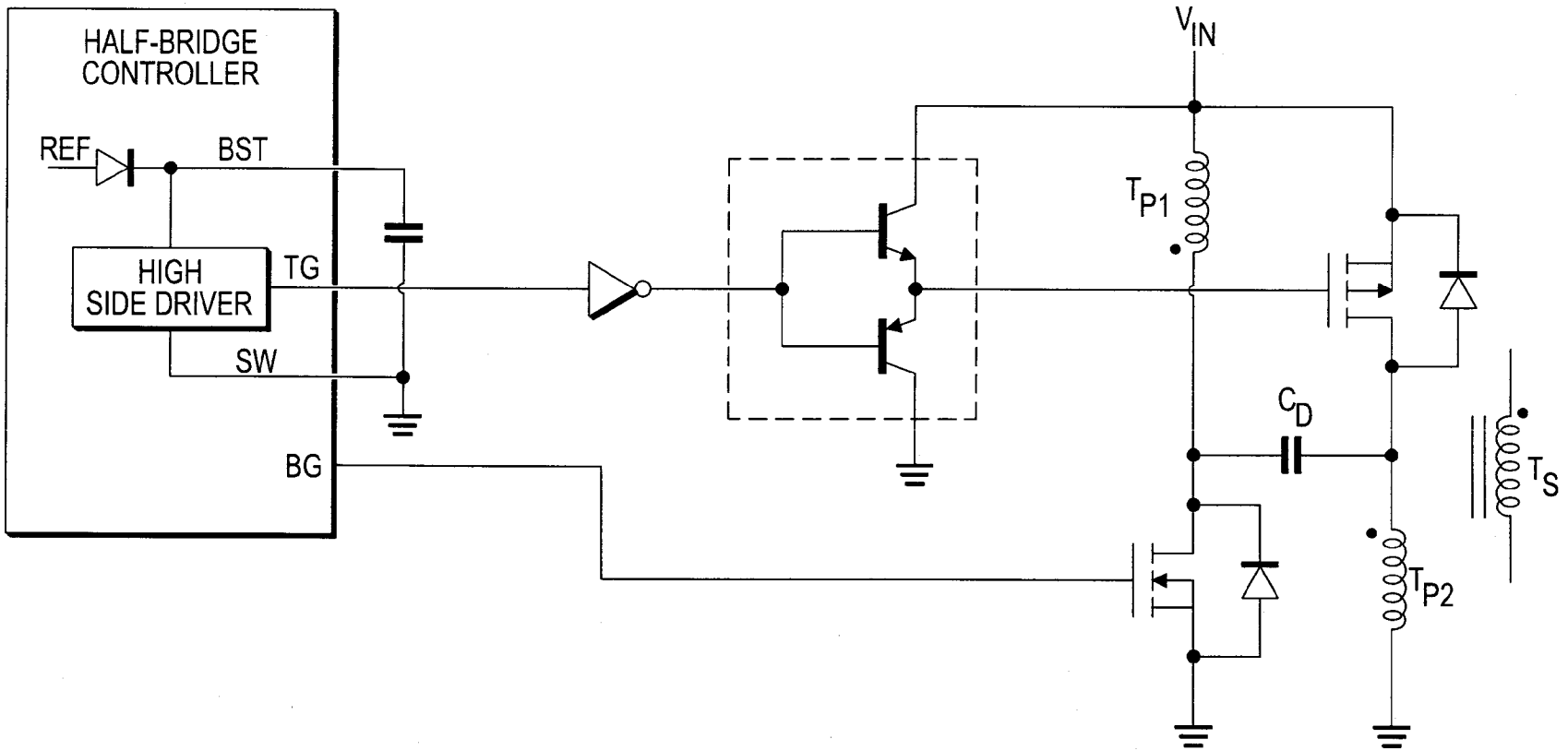
FIG. 9 illustrates an inverter according to an embodiment.

A half-bridge controller, as is well known in the art of power inverter circuits, may also be used in some embodiments. For some embodiments in which switching element 110 is a power nMOSFET, a half-bridge controller may be used in a conventional fashion to directly drive the gate voltages. For some embodiments in which switching element 110 is realized by a power pMOSFET, some embodiments may utilize a conventional half-bridge controller as shown in the embodiment of FIG. 9.

Figure 10:
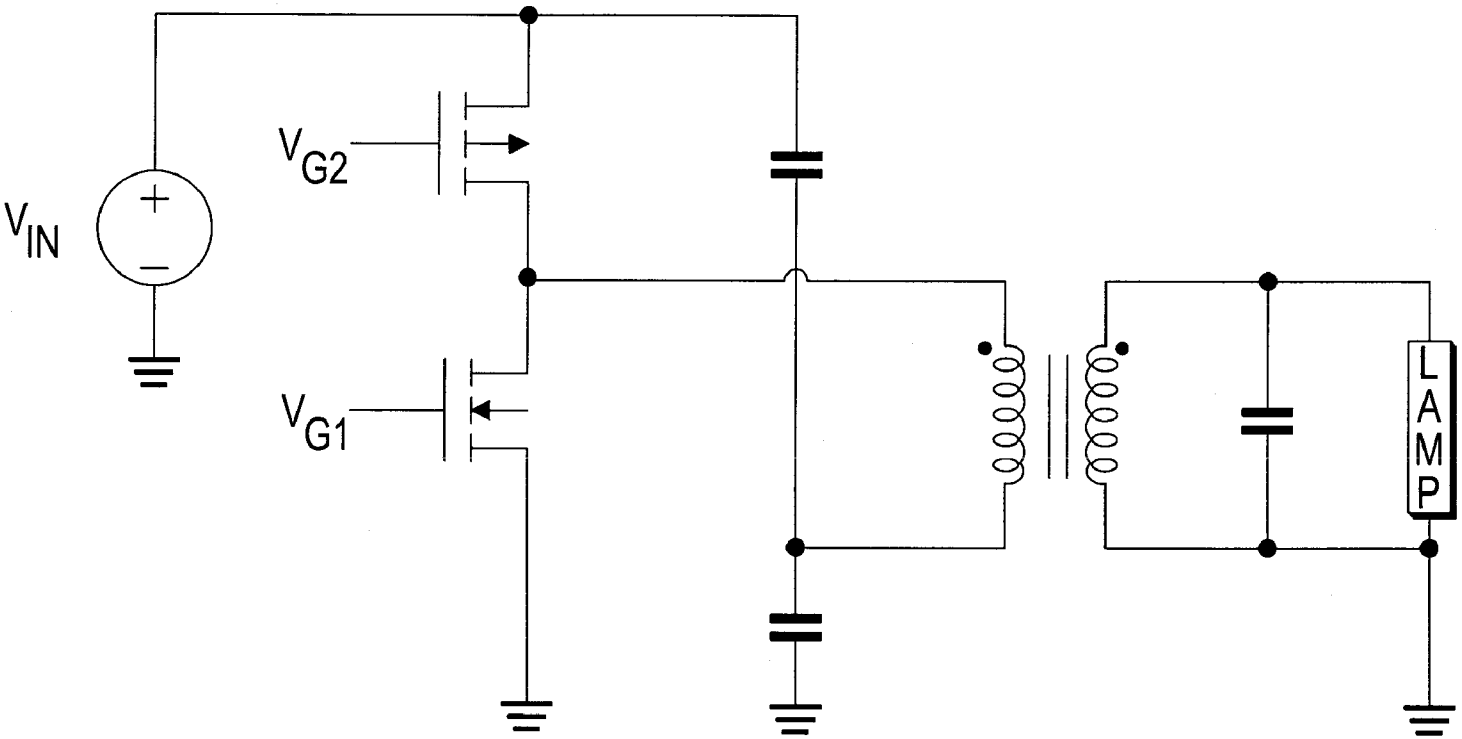
(PRIOR ART) FIG. 10
FIGS. 10 and 11 illustrate prior art inverters.
Figure 11:
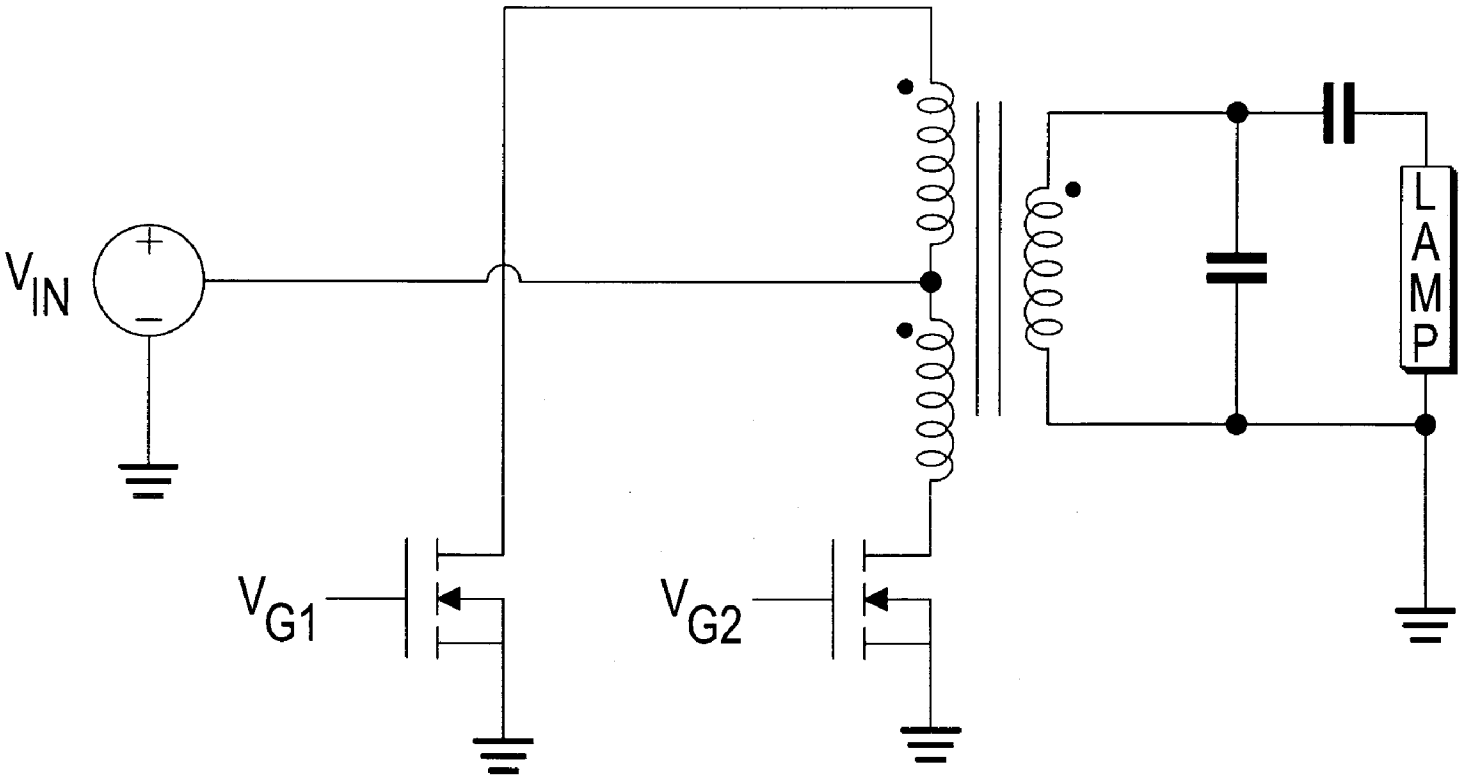
(PRIOR ART) FIG. 11

It is expected that inverter circuits according to some of the embodiments discussed above are more efficient than some prior art inverter circuits, such as those illustrated in FIGS. 10 and 11, because they reduce current in the primary side power MOSFETs by half compared to these prior art circuits. Furthermore, it is expected that when compared to the push-pull inverter circuit of FIG. 11, some embodiments do not have the same degree of voltage spikes, and the maximum voltage stress on the power MOSFETs is expected to be clamped to two times the input voltage $V_{IN}$, where as the push-pull inverter circuit of FIG. 11 may experience voltage ringing of over three to four times $V_{IN}$.

Although the subject matter has been described in language specific to structural features, it is to be understood that the subject matter defined in the appended claims is not necessarily limited to the specific features or acts described above. Rather, the specific features and acts described above are disclosed as example forms of implementing the claims. Accordingly, various modifications may be made to the described embodiments without departing from the scope of the invention as claimed below.

It is to be understood in these letters patent that the meaning of "A is connected to B", where A or B may be, for example, a node or device terminal, is that A and B are connected to each other so that the voltage potentials of A and B are substantially equal to each other. For example, A and B may be connected together by an interconnect (transmission line). In integrated circuit technology, the interconnect may be exceedingly short, comparable to the device dimension itself. For example, the gates of two transistors may be connected together by polysilicon, or copper interconnect, where the length of the polysilicon, or copper interconnect, is comparable to the gate lengths. As another example, A and B may be connected to each other by a switch, such as a transmission gate, so that their respective voltage potentials are substantially equal to each other when the switch is ON.

It is also to be understood in these letters patent that the meaning of "A is coupled to B" is that either A and B are connected to each other as described above, or that, although A and B may not be connected to each other as described above, there is nevertheless a device or circuit that is connected to both A and B. This device or circuit may include active or passive circuit elements, where the passive circuit elements may be distributed or lumped-parameter in nature. For example, A may be connected to a circuit element that in turn is connected to B.

It is also to be understood in these letters patent that various circuit components and blocks, such as current mirrors, amplifiers, etc., may include switches so as to be switched in or out of a larger circuit, and yet such circuit components and blocks may still be considered connected to the larger circuit.

What is claimed is:

1. A circuit comprising:

a capacitor having a first terminal and a second terminal;

a low-side switching element having a first terminal connected to the first terminal of the capacitor, and having a second terminal;

a high-side switching element having a first terminal connected to the second terminal of the capacitor, and having a second terminal;

a first primary winding having a first terminal connected to the first terminal of capacitor, and having a second terminal connected to the second terminal of the high side switching element;

a second primary winding having a first terminal connected to the second terminal of the capacitor, and having a second terminal, wherein the first terminal of the second primary winding is connected to the second terminal of the first primary winding through the high-side switching element; and a secondary winding magnetically coupled to the first and second primary windings;

wherein the first primary winding having a first voltage drop from the first terminal of the first primary winding to the second terminal of the first primary winding; and the second primary winding having a second voltage drop from the first terminal of the second primary winding to the second terminal of the second primary winding;

further wherein the first voltage drop and the second voltage drop have the same algebraic sign.

2. The circuit as set forth in claim 1, further comprising:

a ground rail connected to the second terminal of the low-side switching element and to the second terminal of the second primary winding.

3. The circuit as set forth in claim 2, further comprising:

a DC voltage source having a high-side terminal connected to the second terminal of the first primary winding and to the second terminal of the high-side switching element, and having a low-side terminal connected to the ground rail.

4. The circuit as set forth in claim 1, further comprising a controller circuit so that the low-side and high-side switching elements have non-overlapping ON times.

5. The circuit as set forth in claim 1, wherein the first voltage drop is substantially equal to the second voltage drop.

6. The circuit as set forth in claim 5, further comprising:

a ground rail connected to the second terminal of the low-side switching element and to the second terminal of the second primary winding.

7. The circuit as set forth in claim 5, further comprising:

a secondary winding magnetically coupled to the first and second primary windings.

8. The circuit as set forth in claim 7, further comprising:

a cold cathode fluorescent light coupled to the secondary winding.

9. The circuit as set forth in claim 8, further comprising:

a DC voltage source connected to the second terminal of the first primary winding and to the second terminal of the high-side switching element.

10. The circuit as set forth in 7, further comprising:

a resonant circuit connected to the secondary winding.

11. The circuit as set forth in claim 10, further comprising:

a ground rail connected to the second terminal of the low-side switching element and to the second terminal of the second primary winding.

12. The apparatus as set forth in claim 11, further comprising:

a cold cathode fluorescent light connected to the resonant circuit and to the ground rail.

13. The apparatus as set forth in claim 12, further comprising:

a DC voltage source having a high-side terminal connected to the second terminal of the first primary winding and to the second terminal of the high-side switching element, and having a low-side terminal connected to the ground rail.

14. The circuit as set forth in claim 1, further comprising a controller circuit so that the low-side and high-side switching elements have non-overlapping ON times.

15. The circuit as set forth in claim 1, wherein the low-side switching element comprises an nMOSFET.

16. The circuit as set forth in claim 15, wherein the high-side switching element comprises a diode.

17. The circuit as set forth in claim 15, wherein the high-side switching element comprises an nMOSFET.

18. The circuit as set forth in claim 15, wherein the high-side switching element comprises a pMOSFET.

* * * * *